US009085156B1

(12) United States Patent
Kobayashi

(10) Patent No.: US 9,085,156 B1
(45) Date of Patent: Jul. 21, 2015

(54) PRINTER

(71) Applicant: BROTHER KOGYO KABUSHIKI KAISHA, Nagoya-shi (JP)

(72) Inventor: Haruo Kobayashi, Ichinomiya (JP)

(73) Assignee: BROTHER KOGYO KABUSHIKI KAISHA, Nagoya-shi (JP)

( * ) Notice: Subject to any disclaimer, the term of this patent is extended or adjusted under 35 U.S.C. 154(b) by 0 days.

(21) Appl. No.: 14/480,099

(22) Filed: Sep. 8, 2014

(30) Foreign Application Priority Data

Feb. 14, 2014 (JP) ..... 2014-026961

(51) Int. Cl.
*B41J 2/165* (2006.01)

(52) U.S. Cl.
CPC ..... *B41J 2/16505* (2013.01)

(58) Field of Classification Search
CPC ..... B41J 2/17596; B41J 29/38; B41J 2/175; B41J 2/1652; B41J 2/16523; B41J 2/16547
USPC ..... 347/22, 29, 30, 34–36, 85–86, 89–90
See application file for complete search history.

(56) References Cited

U.S. PATENT DOCUMENTS 8,147,044 B2 * 4/2012 Yokouchi ..... 347/85
8,602,521 B2 * 12/2013 Sato et al. ..... 347/30

FOREIGN PATENT DOCUMENTS

JP 2006-035658 A 2/2006

* cited by examiner

*Primary Examiner* — Thinh Nguyen
(74) *Attorney, Agent, or Firm* — Fox Rothschild LLP

(57) ABSTRACT

A printer includes a cap member, a head, a suction pump, a first electromagnetic valve, and a waste liquid flow path including a first flow path portion and a second flow path portion. The cap member seals a discharge surface in the head. The suction pump is connected to the waste liquid flow path and puts it into a negative pressure state. The first electromagnetic valve connects the cap member and the suction pump, cuts off the connection between the cap member and the waste liquid flow path, and includes a first wall portion. The first wall portion includes a side face portion on which an inflow opening and an outflow opening are formed. The inflow opening connects to the first flow path portion. The outflow opening connects to the second flow path portion and is disposed farther in the direction of the force of gravity than the inflow opening.

7 Claims, 10 Drawing Sheets

PRINTER

CROSS-REFERENCE TO RELATED APPLICATION

This Application claims priority to Japanese Patent Application No. 2014-026961, filed on Feb. 14, 2014, the content of which is hereby incorporated by reference.

BACKGROUND

The present disclosure relates to a printer.

A printer is known that performs maintenance on a print head. The printer is capable of performing purging, and it is provided with the print head and a purge unit. The purge unit is provided with a cap member and with a suction pump that is connected to the cap member. The purging is performed by the suction pump's drawing of ink from the print head when the cap member is in close contact with a discharge surface. Here, a printer will be considered that is provided with a tube member within which is formed a flow path between the cap member and the suction pump and with a valve that opens and closes the flow path. In a case where the valve closes the flow path, the connection between the cap member and the suction pump is cut off. In a case where the valve opens the flow path, the cap member and the suction pump are connected to one another, and the ink that the suction pump draws flows within the tube member.

SUMMARY

However, in the printer that is described above, depending on the type of valve and the type of ink that are used, there is a possibility that the ink will accumulate within and adhere to the valve. This can cause the flow of the ink within the tube member to be impeded, so there is a possibility that the maintenance of the print head will not be performed well.

Embodiments of the broad principles derived herein provide a printer that is able to perform maintenance of the print head well by inhibiting the accumulation of a liquid that a suction pump draws in the interior of a valve that allows the inflow and outflow of the liquid.

A printer according to a first embodiment of the present disclosure includes at least one head, at least one cap member, at least one movement device, at least one waste liquid flow path, at least one suction pump, and a first electromagnetic valve. The at least one head includes a discharge surface. The discharge surface is provided with a nozzle. The nozzle is configured to discharge a liquid. The at least one cap member is configured to move between a sealing position and a retracted position. The sealing position is a position where the at least one cap member seals the discharge surface. The retracted position is a position where the at least one cap member has retracted from the discharge surface. The at least one movement device moves the at least one cap member. The at least one waste liquid flow path is provided with a first flow path portion and a second flow path portion. The at least one suction pump is connected to the at least one waste liquid flow path and is configured to put the at least one waste liquid flow path into a negative pressure state. The first electromagnetic valve is provided in the at least one waste liquid flow path. The first electromagnetic valve is connected to the at least one cap member by the first flow path portion, and is connected to the at least one suction pump by the second flow path portion. The first electromagnetic valve is configured to cut of the connection between the at least one cap member and the at least one waste liquid flow path. The first electromagnetic valve is provided with a first wall portion, a first valve member, a first energizing member, and a first drive portion. The first wall portion includes a side face portion on which an inflow opening, an outflow opening, and a connecting groove are formed. The inflow opening connects to the first flow path portion. The outflow opening connects to the second flow path portion and is disposed farther in the direction of the force of gravity than is the inflow opening. The connecting groove connects the inflow opening and the outflow opening. The first valve member is configured to shift between a first blocking orientation and a first open orientation. The first blocking orientation is an orientation in which the first valve member blocks the connecting groove by being disposed in a position where it is opposite the side face portion and covers the connecting groove. The first open orientation is an orientation in which the first valve member opens the connecting groove. The first energizing member imparts to the first valve member a first elastic force that shifts the first valve member to the first blocking orientation. The first drive portion shifts the first valve member from the first blocking orientation to the first open orientation in opposition to the first elastic force.

BRIEF DESCRIPTION OF THE DRAWINGS

Embodiments will be described below in detail with reference to the accompanying drawings in which.

DETAILED DESCRIPTION

Figure 1:
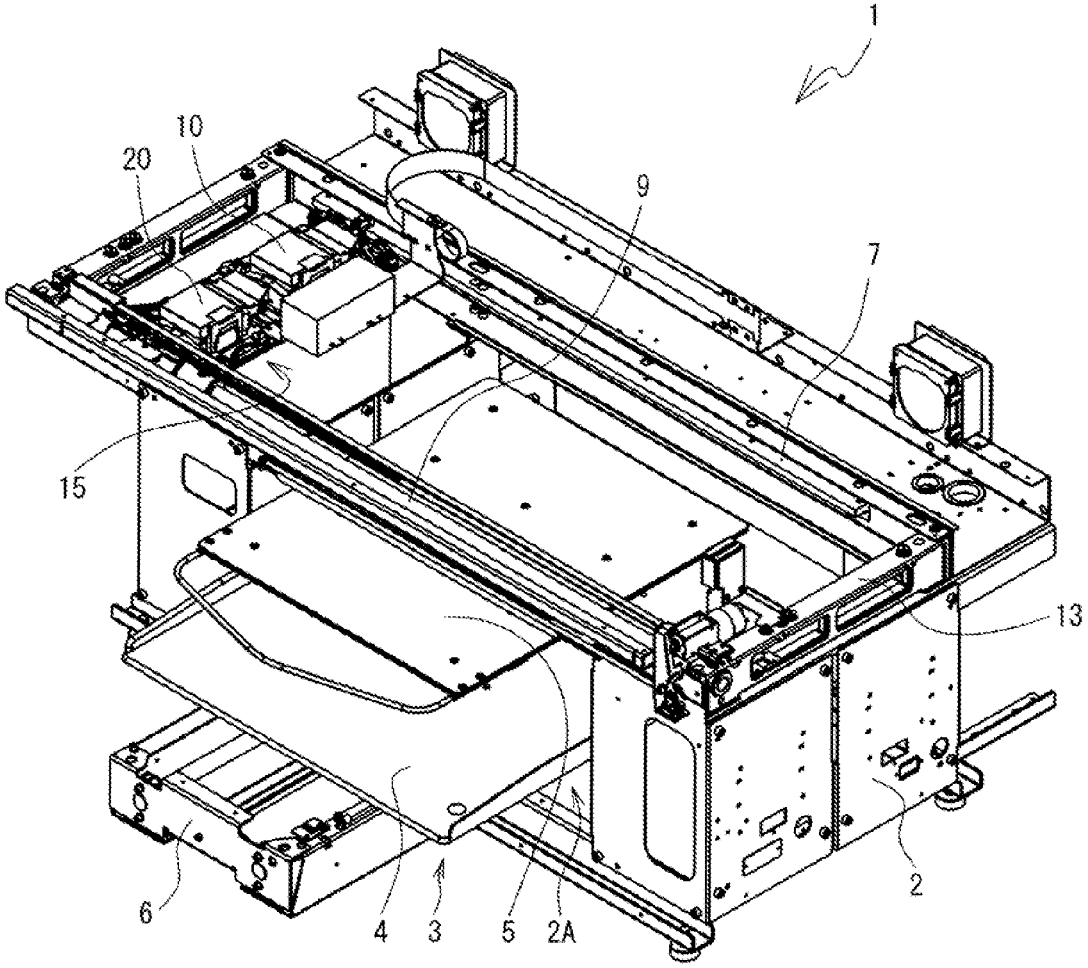
FIG. 1 is an oblique view of a printer 1 as viewed obliquely from the upper right.

Hereinafter, an embodiment of the present disclosure will be explained with reference to the drawings. Note that the drawings are used for explaining technological features that the present disclosure can utilize. Accordingly, device configurations, flowcharts for various types of processing, and the like that are shown in the drawings are merely explanatory examples and do not serve to restrict the present disclosure to those configurations, flowcharts, and the like, unless otherwise indicated specifically. First, an overall configuration of a printer 1 will be explained with reference to FIG. 1. Note that the top side, the bottom side, the lower right side, the upper left side, the lower left side, and the upper right side in FIG. 1 respectively correspond to the top side, the bottom side, the right side, the left side, the front side, and the rear side of the printer 1.

The printer 1 is an inkjet printer that performs printing by discharging a liquid ink onto the surface of a cloth such as a T-shirt or the like (not shown in the drawings) that is a printing medium. In the present embodiment, the printer 1 performs printing of a color image on the printing medium by discharging five different types of the ink (white, black, cyan, magenta, and yellow) downward. In the explanation that follows, the five types of the ink will he collectively called the ink, the white ink will be called the white ink, and the black, cyan, magenta, and yellow inks will be collectively called the color inks. In the printer 1 in the present embodiment, the ink contains a binder resin to provide the printed cloth with high washing fastness. Furthermore, the white ink contains titanium oxide, for example, as a pigment.

The white ink is discharged onto the cloth as a first-stage processing liquid. The color inks are discharged onto the cloth as second-stage processing liquids after the white ink has been discharged. In the present embodiment, in a case where an image will be printed on a cloth with a dark ground color, for example, the white ink is used as a base coat. Depending on the printed image, the second-stage processing color inks will not necessarily he discharged after the first-stage processing white ink is discharged, More specifically, there may be areas on the surface of the cloth where only the white ink is discharged and other areas where only the color inks are discharged. Moreover, depending on the printed image, the white ink may also be discharged as a second-stage processing liquid.

As shown in FIG. 1, the printer 1 is provided with a housing 2, a platen mechanism 3, a frame 13, a carriage 15, a maintenance mechanism 30 (refer to FIG. 2), and the like. The shape of the housing 2 is substantially a three-dimensional rectangle whose long axis extends from left to right, and an opening is provided at the top of the housing 2. An opening 2A that is substantially rectangular in a front view and is continuous with the interior of the housing 2 is provided in the front face of the housing 2, approximately centered between the left and right sides.

The platen mechanism 3 is a mechanism for conveying the cloth not shown in the drawings) toward the front and the rear, and it is provided inside the housing 2, approximately centered between the left and right sides. The platen mechanism 3 is provided with a base 6, a tray 4, a platen 5, and the like. The base 6 is substantially box-shaped and extends in the front-rear direction through the opening 2A. A pair of rails (not shown in the drawings) that extend in the front-rear direction are provided inside the base 6.

The tray 4 is a plate that is substantially rectangular in a plan view, and it is provided above the base 6. The tray 4 can move along the pair of the rails in conjunction with the operating of a platen drive motor (not shown in the drawings) that is provided in the interior of the housing 2. The platen 5 is a plate that is substantially rectangular in a plan view, and it is supported by a support column (not shown in the drawings) that is provided such that it extends vertically upward from the rear edge of the tray 4. The portion of the cloth on which the printing will be performed (for example, the front of a T-shirt or the like) can be placed on the top face of the platen 5. The portions of the cloth on which the printing will not be performed (for example, the sleeves of a T-shirt or the like) can be placed on the top face of the tray 4. The platen 5 can move along the pair of the rails together with the tray 4.

The frame 13 is a frame-shaped member that is rectangular in a plan view, and it is provided on top of the housing 2. A guide rail 7 and a guide shaft 9 are provided inside the frame 13. The guide rail 7 is a three-dimensional rectangular member whose long axis extends from left to right, and it projects from the front side of at rear wall of frame 13. The guide shaft 9 is a shaft member that extends from left to right, and it is provided on the front side of the frame 13. The guide rail 7 and the guide shaft 9 are disposed at approximately the same height.

The carriage 15 is provided such that it can move reciprocally inside the frame 13 along the guide rail 7 and the guide shaft 9. The carriage 15 moves in conjunction with the operating of a carriage drive motor (not shown in the drawings) that is provided in the housing 2. In a case where the printer 1 is not performing a printing operation, the carriage 15 is disposed in a position (hereinafter called the standby position) that is the farthest to the left within the area in which it can move. Note that in the printer 1 that is shown in FIG. 1, the carriage 15 is positioned in the standby position. In the carriage 15, a first head unit 10 that discharges the white ink and a second head unit 20 that discharges the color inks are provided such that they are arrayed in the front-rear direction. The first head unit 10 is positioned to the rear of the second head unit 20.

The first head unit 10 is connected through four white ink supply tubes (not shown in the drawings) to four main tanks (not shown in the drawings) in which the white ink is stored. On its bottom side, the first head unit 10 has a first discharge portion 11 that discharges the white ink downward. The interior of the first discharge portion 11 is partitioned from left to right into four interior spaces (not shown in the drawings) that respectively correspond to the four white ink supply tubes. The first discharge portion 11 has a first discharge surface 12 on which are provided a plurality of nozzles (not shown in the drawings) that can discharge the white ink. The first discharge surface 12 is formed on the bottom face of the first discharge portion 11. On the first discharge surface 12, four discharge areas that respectively correspond to the four interior spaces are formed from left to right. Of the four discharge areas on the first discharge surface 12, the discharge area that is the farthest to right side will be called the first discharge area, and the remaining three discharge areas will be collectively called the second discharge areas.

The second head unit 20 is connected through four color ink supply tubes to main tanks in which the corresponding color inks are stored. On its bottom side, the second head unit 20 has a second discharge portion 21 that discharges the color inks downward. The interior of the second discharge. portion 21 is partitioned from left to right into four interior spaces (not shown in the drawings) that respectively correspond to the colors of the color inks. The second discharge portion 21 has a second discharge surface 22 on which are provided a plurality of nozzles (not shown in the drawings) that can discharge the color inks. The second discharge surface 22 is formed on the bottom face of the second discharge portion 21. Four discharge areas that respectively correspond to the four interior spaces are formed on the second discharge surface 22. Starting front the right side, the four discharge areas can respectively discharge the black ink, the cyan ink, the magenta ink, and the yellow ink. Note that in the explanation that follows, the first discharge portion 11 and the second discharge portion 21 will be called the discharge portions when referenced collectively, the first discharge surface 12 and the second discharge surface 22 will be called the discharge surfaces when referenced collectively, and the nozzles that are provided on the first discharge surface 12 and the second discharge surface 22 will be called the nozzles when referenced collectively.

Figure 2:
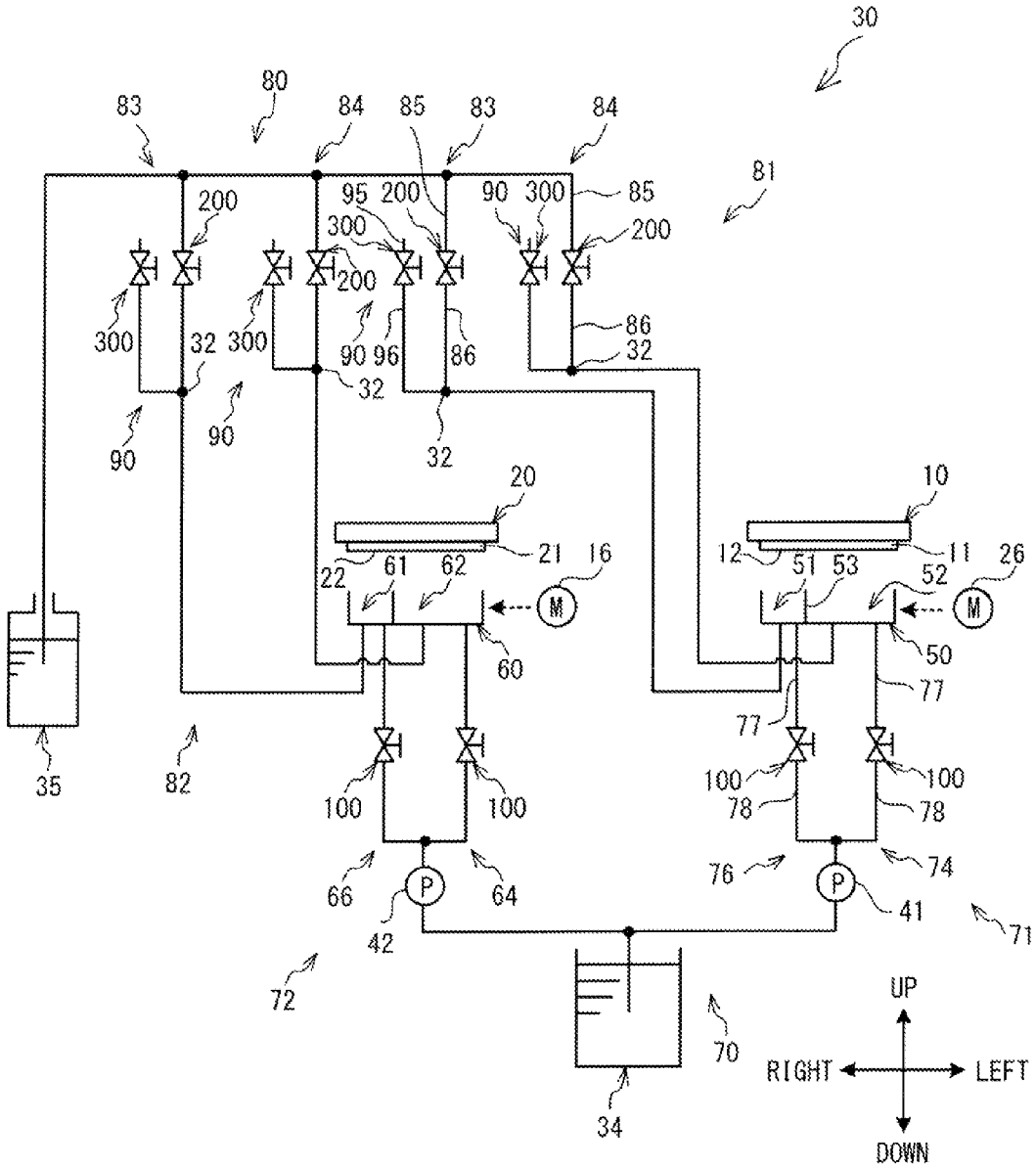
FIG. 2 is a flow diagram of a maintenance mechanism 30.
Figure 7:
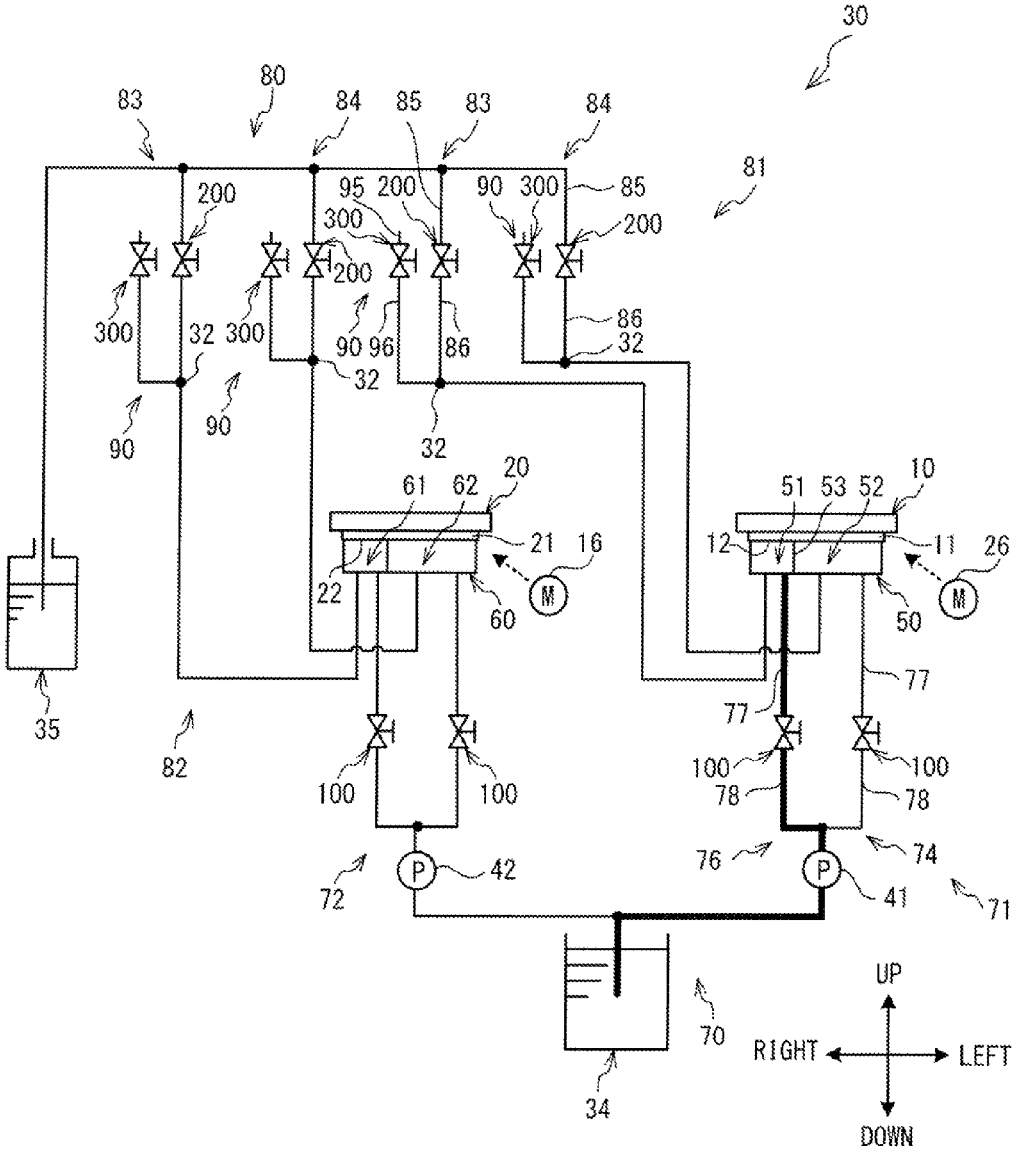
FIG. 7 is a flow diagram of the maintenance mechanism 30 performing purging.
Figure 9:
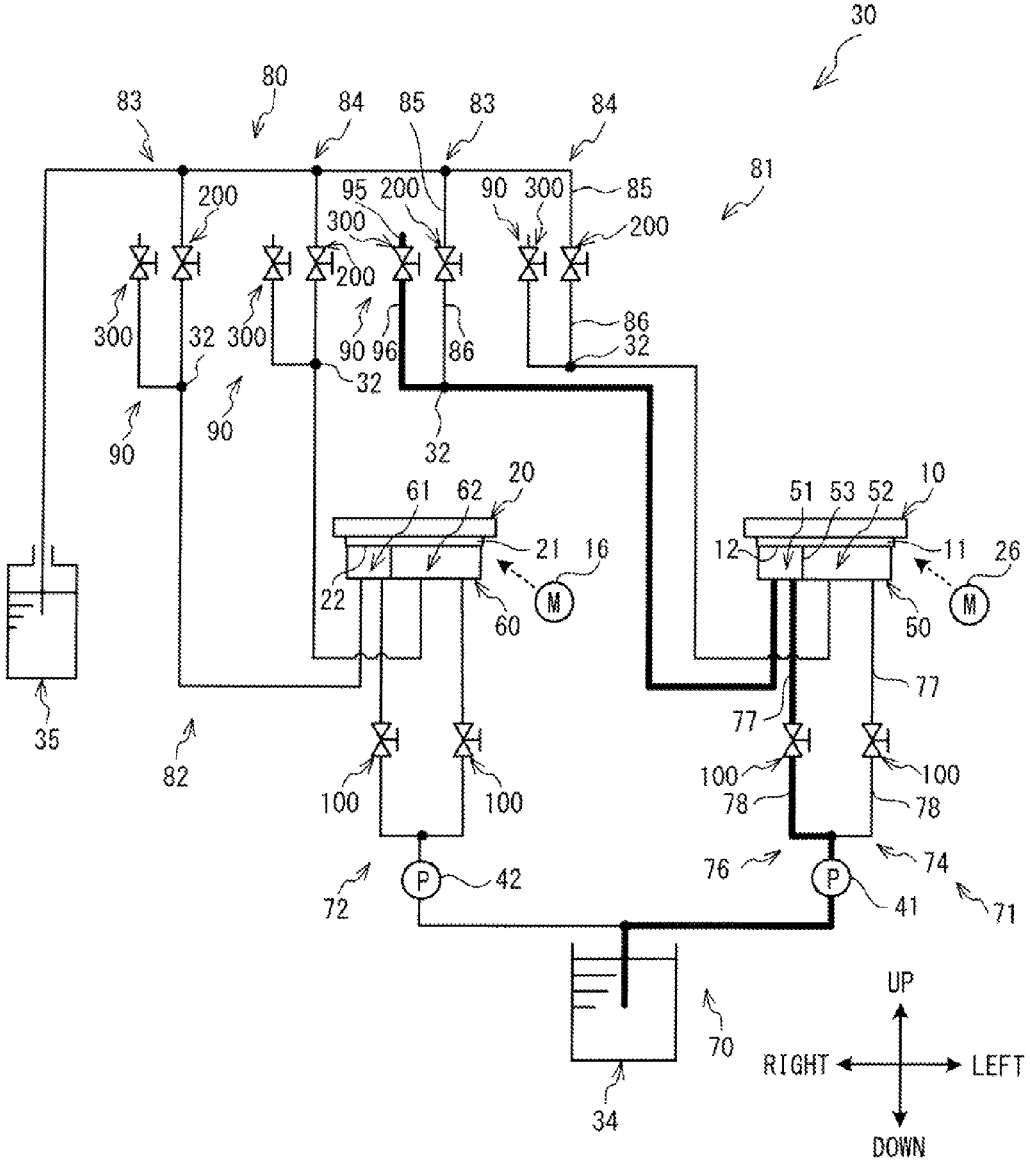
FIG. 9 is a flow diagram of the maintenance mechanism 30 performing aspiration.
Figure 10:
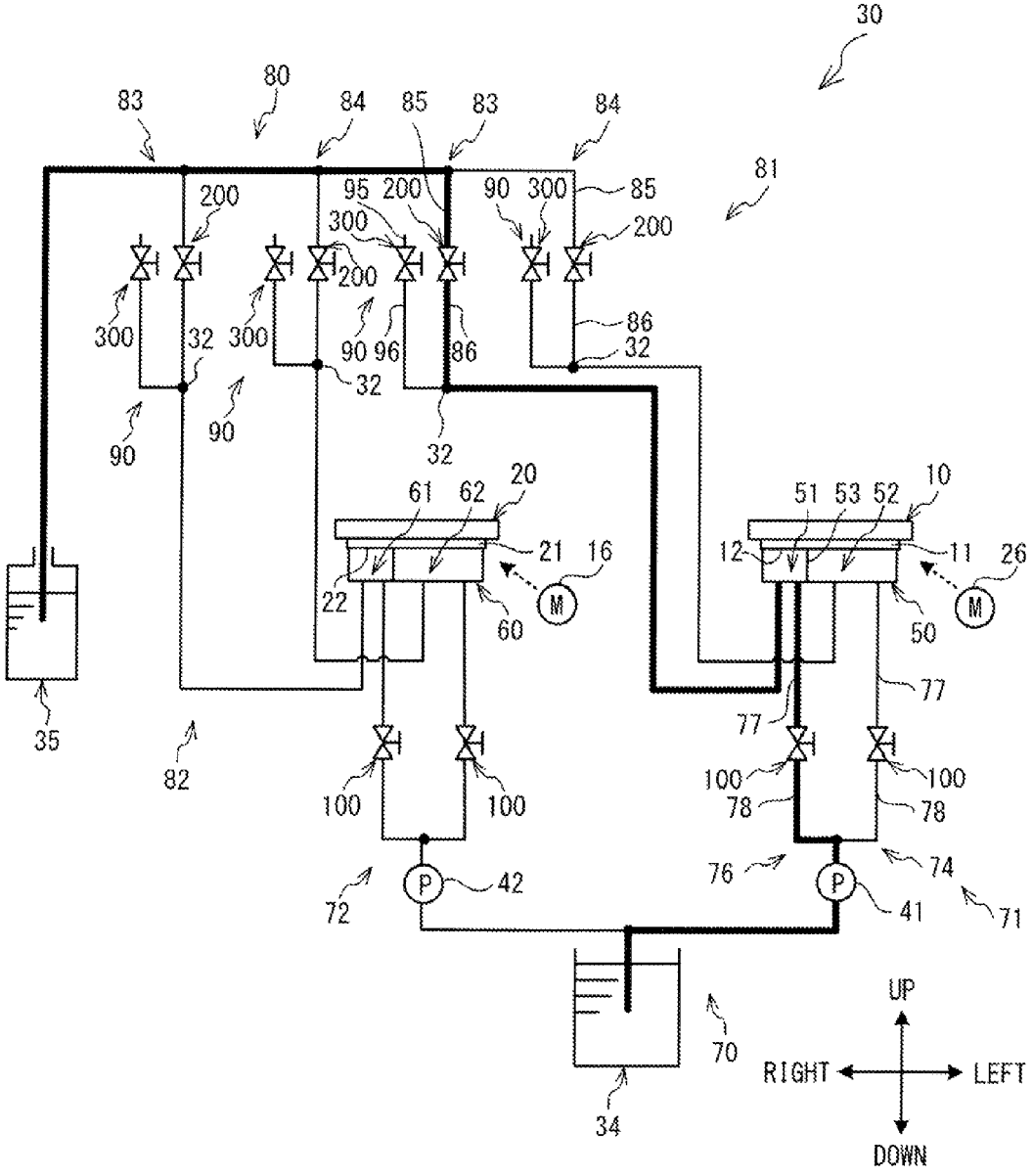
FIG. 10 is a flow diagram of the maintenance mechanism 30 performing cleaning.

The maintenance mechanism 30 will he explained with reference to FIG. 2. The top side, the bottom side, the left side, and the right side in FIG. 2 respectively correspond to the top side, the bottom side, the right side, the left side of the maintenance mechanism 30. Further, in FIG. 2, in order to make the drawing easier to view, the maintenance mechanism 30 is drawn schematically, and the first head unit 10 is shown as being disposed to the left of the second head unit 20 (on the right side in FIG. 2), instead of behind the second head unit 20 (FIGS. 7, 9, and 10 are the same).

The maintenance mechanism 30 is provided underneath the standby position for the carriage 15 (refer to FIG. 1) and to the left of the platen mechanism 3 (refer to FIG. 1). The maintenance mechanism 30 is a mechanism for performing maintenance operations that prevent defective discharging from the discharge surfaces. The maintenance operations include capping, purging, aspiration, and cleaning, which will be described later. Capping is an operation that uses a first suction cap 50 and a second suction cap 60 to seal the first discharge surface 12 and the second discharge surface 22, respectively. Purging is an operation that draws the ink out of the nozzles. Aspiration is an operation that, after purging has been performed, uses suction to supply outside air into the first suction cap 50 and the second suction cap 60. Cleaning is an operation that cleans the discharge surfaces with a cleaning liquid. In the explanation that follows, purging, aspiration, and cleaning will be called purging and the like when referenced collectively.

The maintenance mechanism 30 is provided with the first suction cap 50, the second suction cap 60, a suction portion 70, and a cleaning liquid supply portion 80. The first suction cap 50 is a cap member that can be attached to and removed from the first discharge surface 12. The first suction cap 50 is substantially formed into a box shape that is provided with an opening at its top, and it is connected to a first drive motor 26 through a gear and the like (not shown in the drawings). The first suction cap 50 is able to move between a sealing position (refer to FIG. 7) and a retracted position (refer to FIG. 2). The scaling position is a position where the first suction cap 50 seals the first discharge surface 12 in conjunction with the rotational movement of the first drive motor 26. The retracted position is a position to which the first suction cap 50 retracts downward from the first discharge surface 12. In the sealing position, the first suction cap 50 performs capping by covering the first discharge portion 11 from below.

A wall portion 53 that extends in the front-rear direction is provided in the interior of the first suction cap 50. The providing of the wall portion 53 divides the interior of the first suction cap 50 into a right side space 51 that is formed to the right of the wall portion 53 and a left side space 52 that is formed to the left of the wall portion 53. The right side space 51 is positioned below the first discharge area, and the left side space 52 is positioned below the second discharge areas.

The second suction cap 60 is a cap member that can be attached to and removed from the second discharge surface 22. The second suction cap 60 has the same shape as the first suction cap 50, and it is able to move between a sealing position (refer to FIG. 7) and a retracted position (refer to FIG. 2) in conjunction with the rotational movement of a second drive motor 16 to which it is connected. The sealing position is a position where the second suction cap 60 seals the second discharge surface 22. The retracted position is a position to which the second suction cap 60 retracts downward from the second discharge surface 22. A right side space 61 in the second suction cap 60 is positioned below the area, among the discharge areas on the second discharge surface 22 that discharge the four inks, where the black ink is discharged. A left side space 62 in the second suction cap 60 is positioned below the areas where the remaining three inks (the cyan ink, the magenta ink, and the yellow ink) are discharged.

The suction portion 70 includes a waste liquid tank 34, a first suction flow path 71, and a second suction flow path 72. The waste liquid tank 34 is a storage portion in which the ink and the cleaning liquid that are used accumulate as waste liquids when purging and the like are performed on the first discharge portion 11 and the second discharge portion 21. The waste liquid tank 34 is provided in a lower position than the first suction cap 50 and the second suction cap 60.

The first suction flow path 71 is a flow path where the ink and the cleaning liquid that are used in purging and the like on the first discharge surface 12 flow from the first suction cap 50 toward the waste liquid tank 34. The first suction flow path 71 is provided with a right side waste liquid flow path 76, a left site waste liquid flow path 74, and a first suction pump 41. The right side waste liquid flow path 76 is a flexible tube member that connects the right side space 51 and the first suction pump 41. An electromagnetic, valve 100 that can cut off the connection between the right side space 51 and the first suction pump 41 is provided in the right side waste liquid flow path 76. In an on state, the electromagnetic valve 100 allows the right side space 51 and the first suction pump 41 to be connected, and in an off state, it cuts off the connection. The right side waste liquid flow path 76 is formed by a first flow path portion 77, which is a flow path on the upstream side of the electromagnetic valve 100, and a second flow path portion 78, which is a flow path on the downstream side of the electromagnetic valve 100. The first flow path portion 77 connects the right side space 51 and the electromagnetic valve 100, and the second flow path portion 78 connects the electromagnetic valve 100 and the first suction pump 41.

The left side waste liquid flow path 74 is a flexible tube member that connects the left side space 52 and the first suction pump 41, and it is configured in the same manner as the right side waste liquid flow path 76. In other words, an electromagnetic valve 100 is provided in the left side waste liquid flow path 74, and the left side waste liquid flow path 74 is formed by a first flow path portion 77, which is a flow path on the upstream side of the electromagnetic valve 100, and a second flow path portion 78, which is a flow path on the downstream side of the electromagnetic valve 100. The first suction pump 41 is a pump that is able to put the right side waste liquid flow path 76 and the left side waste liquid flow path 74 into a negative pressure state. The first suction pump 41 is able to send a liquid it has drawn to the waste liquid tank 34.

The second suction flow path 72 is a flow path where the ink and the cleaning liquid that are used in purging and the like on the second discharge surface 22 flow from the second suction cap 60 toward the waste liquid tank 34. The second suction flow path 72 is configured in the same manner as the first suction flow path 71 and is provided with a right side waste liquid flow path 66, a left side waste liquid flow path 64, and a second suction pump 42. The right side waste liquid flow path 66 corresponds to the right side waste liquid flow path 76, the left side waste liquid flow path 64 corresponds to the left side waste liquid flow path 74, and the second suction pump 42 corresponds to the first suction pump 41. An electromagnetic valve 100 is provided in each of the right side waste liquid flow path 66 and the left side waste liquid flow path 64.

The cleaning liquid supply portion 80 is provided with a cleaning liquid tank 35, a first supply portion 81, and a second supply portion 82. The cleaning liquid tank 35 is a storage portion that stores the cleaning liquid, and it is provided in a lower position than the first discharge surface 12 and the second discharge surface 22.

The first supply portion 81 is a flow path portion for supplying the cleaning liquid from the cleaning liquid tank 35 to the first suction cap 50. The first supply portion 81 is provided with a right side cleaning liquid flow path 83 and a left side cleaning liquid flow path 84. The right side cleaning liquid flow path 83 is a flexible tube member that connects the cleaning liquid tank 35 and the right side space 51 of the first suction cap 50. An electromagnetic valve 200 that can cut off the connection between the cleaning liquid tank 35 and the right side space 51 is provided in the right side cleaning liquid flow path 83. In an on state, the electromagnetic valve 200 allows the cleaning liquid tank 35 and the right side space 51 to be connected, and in an off state, it cuts off the connection. The right side cleaning liquid flow path 83 is formed by a first cleaning liquid flow path 85, which is a flow path on the upstream side of the electromagnetic valve 200, and a second cleaning liquid flow path 86, which is a flow path on the downstream side of the electromagnetic valve 200. The first cleaning liquid flow path 85 connects the cleaning liquid tank 35 and the electromagnetic valve 200, and the second cleaning liquid flow path 86 connects the electromagnetic valve 200 and the first suction cap 50.

A branching portion 32 and an outside air supply flow path 90 are provided in the right side cleaning liquid flow path 83. The branching portion 32 branches of from the second cleaning liquid flow path 86 (that is, the right side cleaning liquid flow path 83) between the first suction cap 50 and the electromagnetic valve 200.

The outside air supply flow path 90 is a flexible tube member that connects the branching portion 32 to outside air. An electromagnetic valve 300 that can cut off the connection between the branching portion 32 and the outside air is provided in the outside air supply flow path 90. The electromagnetic valve 300 is disposed in a higher position than the first discharge surface 12 (in the opposite direction from the force of gravity). In an on state, the electromagnetic valve 300 allows the branching portion 32 to be connected to the outside air, and in an off state, it cuts off the connection. The outside air supply flow path 90 is formed by a first outside air supply flow path 95, which is an outside air flow path on the upstream side of the electromagnetic valve 300, and a second outside air supply flow path 96, which is an outside air flow path on the downstream side of the electromagnetic valve 300.

The left side cleaning liquid flow path 84 is a flexible tube member that connects the cleaning liquid tank 35 and the left side space 52 of the first suction cap 50, and it is configured in the same manner as the right side cleaning liquid flow path 83. The second supply portion 82 is a flow path portion for supplying the cleaning, liquid from the cleaning liquid tank 35 to the second suction cap 60. The second supply portion 82 is configured in the same manner as the first supply portion 81. In the explanation that follows, for the sake of convenience, a reference to simply the right side cleaning liquid flow path 83 indicates the right side cleaning liquid flow path 83 of the first supply portion 81, and a reference to simply the outside air supply flow path 90 indicates the outside air supply flow path 90 that is provided in the right side cleaning liquid flow path 83 of the first supply portion 81.

The configuration of the electromagnetic valve 100 in the off state will be explained with reference to FIGS. 3 to 6. Note that, to facilitate the explanation, the top side, the bottom side, the upper left side, the lower right side, the lower left side, and the upper right side in FIG. 3 respectively correspond to the top side, the bottom side, the left side, the right side, the front side, and the rear side of the electromagnetic valve 100.

Figure 3:
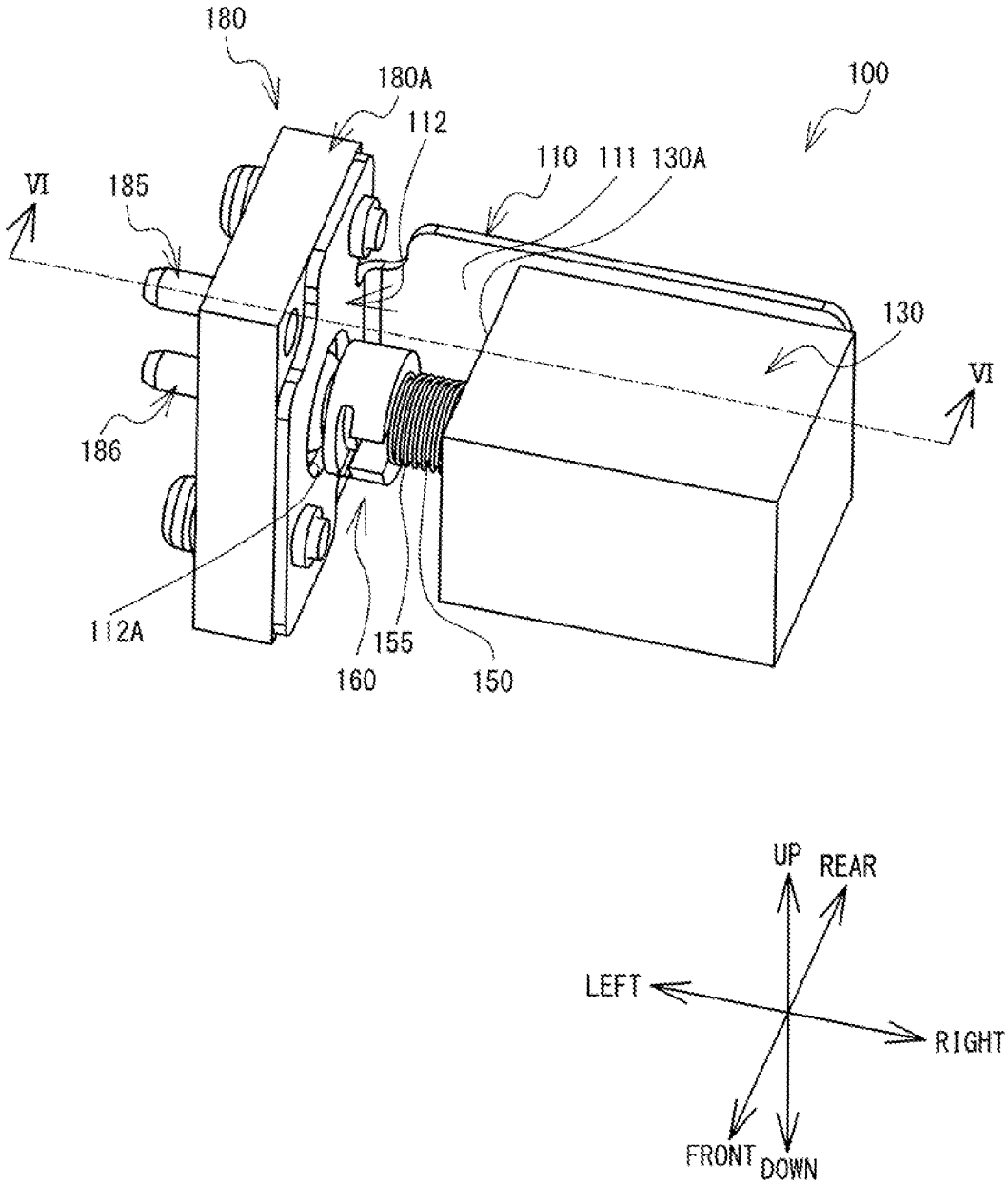
FIG. 3 is an oblique view of an electromagnetic valve 100 as viewed obliquely from the upper right.
Figure 4:
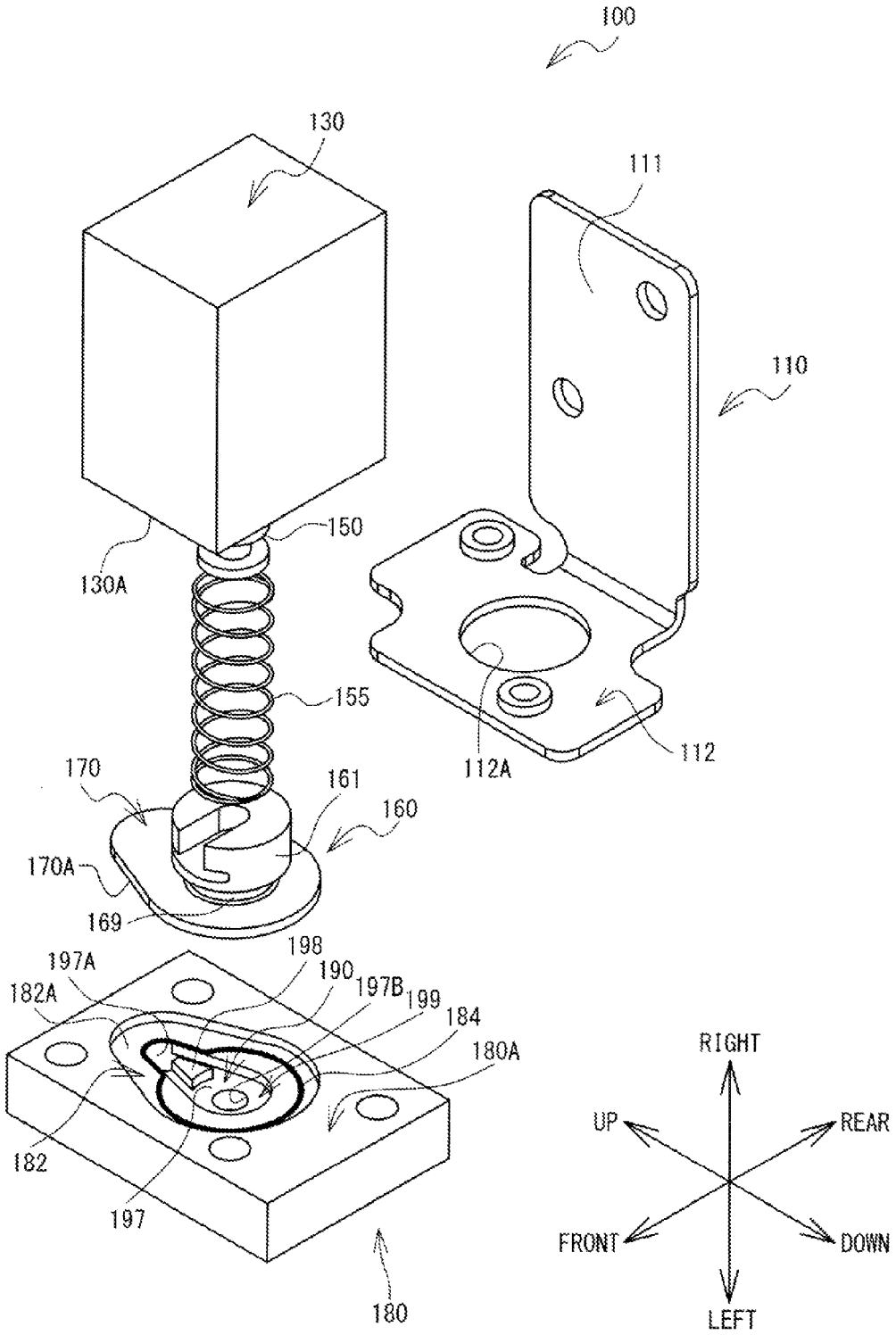
FIG. 4 is an exploded oblique view of the electromagnetic valve 100.

As shown in FIGS. 3 and 4, the electromagnetic valve 100 is provided with a support member 110, a frame 130, a drive portion 150, a valve member 160, a coil spring 155, and a wall portion 180. The support member 110 includes a first plate portion 111 and a second plate portion 112. The first plate portion 111 is substantially rectangular, with its long axis extending from left to right in a front view. The second plate portion 112 is substantially rectangular, with its long axis extending vertically in a right side view, and it extends toward the front from the left end of the first plate portion 111. A through-hole 112A that is substantially circular is provided in a central portion of the second plate portion 112.

The frame 130 is substantially a three-dimensional rectangle with its long axis extending from left to right, and by being affixed to the front face of the first plate portion 111, it is supported by the support member 110. An opening 131 (refer to FIG. 6) is provided in a central portion of a left side face 130A of the frame 130. The opening 131 is substantially circular in a left side view, and it extends from the left toward the right side of the interior of the frame 130. The drive portion 150 is provided inside the opening 131 and has a substantially circular columnar shape whose axis extends from left to right, and its left end protects from the opening 131 toward the second plate portion 112. The drive portion 150 moves reciprocally in the left-right direction inside the opening 131 as the electromagnetic valve 100 is switched between the on and off states.

Figure 5:
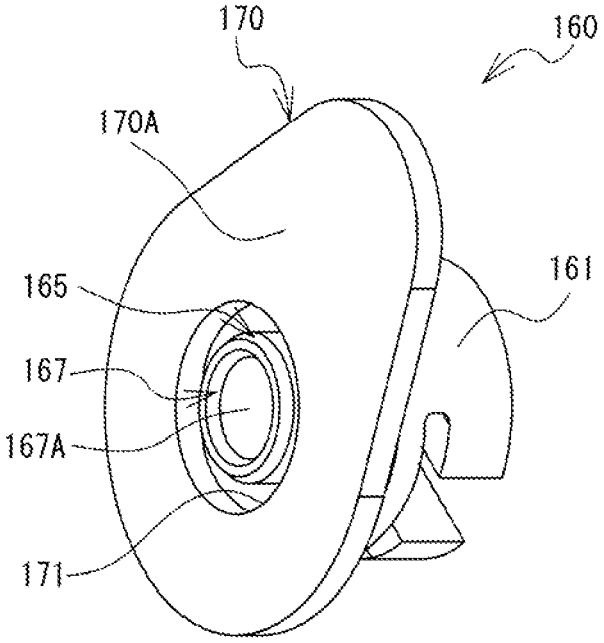
FIG. 5 is an oblique view of a valve member 160 as viewed obliquely from the left front.
Figure 6:
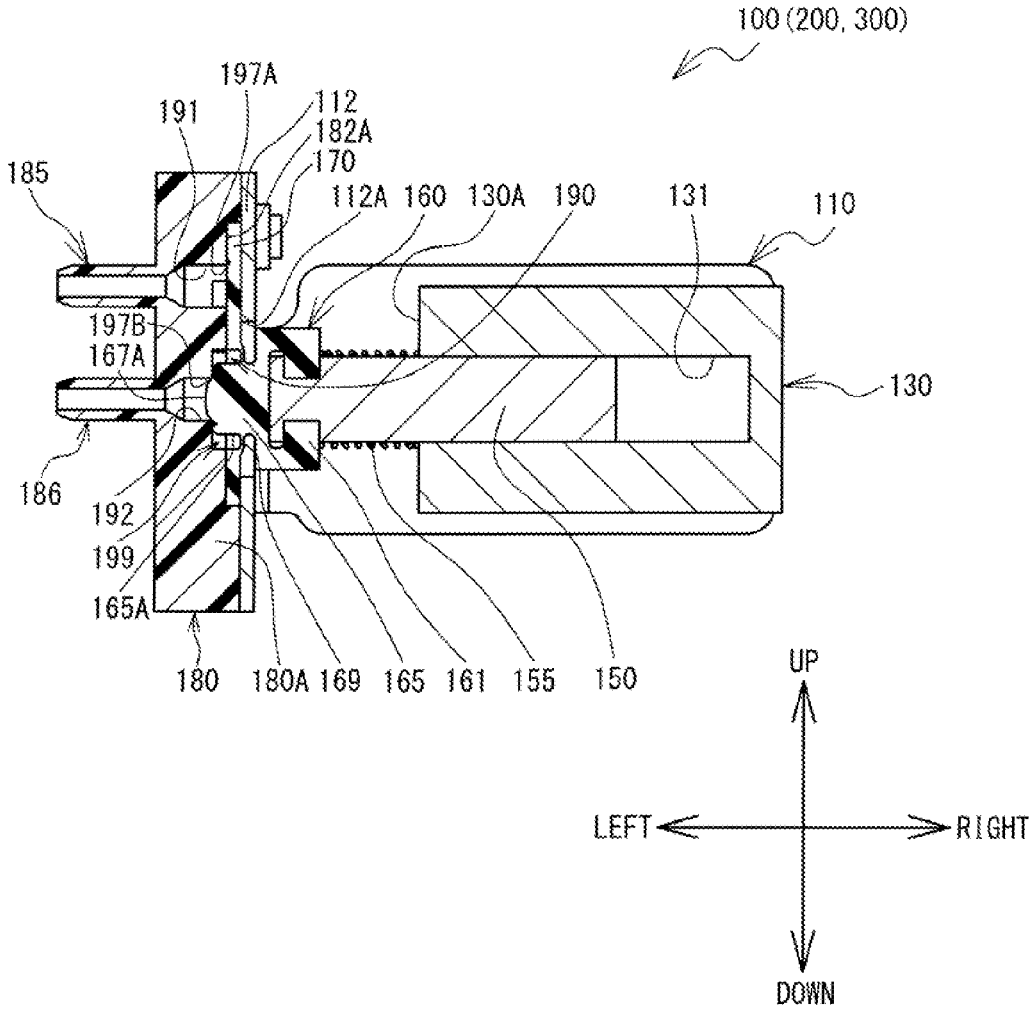
FIG. 6 is a sectional view as viewed along a line VI-VI in FIG. 3.

The valve member 160 is an elastically deformable rubber member that is provided on the left end of the drive portion 150. As shown in FIGS. 4 to 6, the valve member 160 is formed from an attaching portion 161, a sealing portion 165, a connecting portion 169 (refer to FIG. 6), and a cover portion 170. The attaching portion 161 has a substantially circular columnar shape whose axial direction is the left-right direction, and it is attached to the left end of the drive portion 150. The sealing portion 165 has a substantially circular columnar shape that is coaxially linked to the left end of the attaching portion 161, and it is disposed inside the through-hole 112A. A recessed portion 167 (refer to FIG. 5) that is recessed on its right side is formed on the left end face of the sealing portion 165. A sealing face 167A (refer to FIG. 5) that has a substantially circular shape in a left side view is formed on the right end face of the recessed portion 167 (refer to FIG. 8).

The connecting portion 169 (refer to FIG. 6), which is basically shaped like a flange that extends radially outward, is formed around the entire circumference of an outer circumferential face 165A (refer to FIG. 6) that is approximately in the center in the left-right direction of the sealing portion 165. The connecting portion 169 extends approximately in the radial direction, with the outer circumferential face 165A at its base edge, and its outer edge connects to a circumferential edge of an opening 171. The connecting portion 169 is able to deform elastically in conjunction with the movement of the drive portion 150. The orientation of the connecting portion 169 when it is extending approximately in the radial direction from the outer circumferential face 165A will be called the extended orientation.

The cover portion 170 is shaped as a plate whose thickness extends in the left-right direction, and in a left side view, it is formed approximately into a teardrop shape, with its long axis extending in the up-down direction and its width increasing toward the bottom. The length of the cover portion 170 in the up-down direction is greater than the diameter of the through-hole 112A. The substantially circular opening 171 (refer to FIG. 5) is provided in the left side face of the cover portion 170, and the sealing portion 165 is disposed inside the opening 171.

As shown in FIGS. 4 and 6, the coil spring 155 is provided such that it winds around the drive portion 150 between the left side face 130A of the frame 130 and the right side face of the attaching portion 161. The coil spring 155 is disposed in a compressed state, and it energizes the attaching portion 161 toward the left.

The wall portion 180 is substantially a three-dimensional rectangle with its long axis extending up and down, and by being affixed to the left side face of the second plate portion 112, it is supported by the support member 110. The right side face of the wall portion 180 is in contact with the left side face of the second plate portion 112. Attaching portions 185, 186, a right side face portion 180A, a recessed portion 182, a projecting portion 184, and a groove 190 are formed in the wall portion 180 (refer to FIG. 6). The attaching portions 185, 186 have substantially circular cylindrical shapes that extend toward the left from the left side face of the wall portion 180, and they are provided such that one is above the other. The attaching portion 186 is disposed below the attaching portion 185 (in the direction of force of gravity). The outer circumferential faces of the attaching portions 185, 186 are fitted to the inner circumferential faces of the first flow path portion 77 (refer to FIG. 2) and the second flow path portion 78 (refer to FIG. 2), respectively.

As shown in FIG. 6, a cylindrical hole in the attaching portion 185 and a cylindrical hole in the attaching portion 186 are respectively continuous with a first through passage 191 and a second through passage 192, which extend through the wall portion 180 from left to right. The first through passage 191 connects to the first flow path portion 77 (refer to FIG. 2). The second through passage 192 is disposed below the first through passage 191 (in the direction of force of gravity) and connects to the second flow path portion 78 (refer to FIG. 2).

As shown in FIG. 4, the right side face portion 180A is a portion of the wall portion 180 that includes the right side face and also has a specified thickness in the left-right direction. The recessed portion 182 is formed by recessing, toward the left, an area that is approximately in the center of the right side face portion 180A. In a right side view, the shape of the recessed portion 182 is substantially the same as the shape of the cover portion 170. The depth of the recessed portion 182 is substantially the same as the thickness of the cover portion 170. The cover portion 170 is disposed inside the recessed portion 182. The projecting portion 184 is basically formed into a ring shape, and it projects slightly toward the right from a bottom face 182A that forms the left side of the recessed portion 182.

The groove 190 is formed by recessing, toward the left, an area of the bottom face 182A that is on the inner side of the projecting portion 184. In a right side view, the groove 190 is formed approximately into a teardrop shape, with its long axis extending in the up-down direction. A supply opening 197A, a drain opening 197B, and a standing wall 198 are provided on a groove bottom 197 that is the bottom face of the groove 190.

The supply opening 197A is provided in the upper end of the groove bottom 197 and is continuous with the first through passage 191 (refer to FIG. 6). The drain opening 197B is provided in the lower end of the groove bottom 197 and is continuous with the second through passage 192 (refer to FIG. 6). The standing wall 198 forms a substantially triangular shape in a right side view and is provided in an area of the groove bottom 197 that is above the center of the groove bottom 197 in the up-down direction. The upper edge of the standing wall 198 is connected to the lower edge of the supply opening 197A. The bottom face of the standing wall 198 is curved upward in an arc shape. The portion of the groove 190 that is lower than the standing wall 198 (hereinafter called the lower portion 199) is formed in a substantially circular shape in a right side view. The inside diameter of the lower portion 199 is substantially the same as the outside diameter of the sealing portion 165 (refer to FIG. 5).

The groove width of the groove 190 widens from the upper edge of the supply opening 197A to the center of the drain opening 197B. The groove width is the length of the groove 190 in a direction that is orthogonal to both the direction in which the groove 190 extends and the direction of the depth of the groove 190. In other words, the groove width of the groove 190 widens in the front-rear direction from the first through passage 191 toward the second through passage 192.

The positional relationships of the valve member 160 to the second plate portion 112 and the wall portion 180 will be explained with reference to FIGS. 4 and 6. As shown in FIG. 4, the cover portion 170, which is disposed inside the recessed portion 182, is provided in a position in which it faces the right side face portion 180A and covers the right side of the groove 190. A left side face 170A of the cover portion 170 comes into contact with the bottom face 182A of the recessed portion 182 and the right side face of the standing wall 198. As shown in FIG. 6, the cover portion 170 is disposed in a position in which it is sandwiched between the bottom face 182A and the left side face of the second plate portion 112, and its movement in the left-right direction is restricted. The left edge portion of the sealing portion 165 advances into the lower portion 199 and blocks the groove 190 (refer to FIG. 4). The energizing of the attaching portion 161 toward the left by the coil spring 155 causes the valve member 160 to be held in an orientation (hereinafter called the blocking orientation) in which the sealing portion 165 blocks the groove 190. In other words, the coil spring 155 imparts an elastic force that shifts the valve member 160 into the blocking orientation. In a case where the valve member 160 is in the blocking orientation, the energizing force of the coil spring 155 causes the sealing face 167A to seal the drain opening 197B from the right side.

The configurations of the electromagnetic valves 200, 300 will be explained with reference to FIGS. 2 and 6. The electromagnetic valves 200, 300 are configured in the same manner the electromagnetic valve 100. The electromagnetic valves 200, 300 are each provided with the support member 110, the frame 130, the drive portion 150, the valve member 160, the coil spring 155, and the wall portion 180. In the wall portion 180 of the electromagnetic valve 200, the first cleaning liquid flow path 85 is fitted to the attaching portion 185, and the second cleaning liquid flow path 86 is fitted to the attaching portion 186. In the wall portion 180 of the electromagnetic valve 300, the first outside air supply flow path 95 is fitted to the attaching portion 185, and the second outside air supply flow path 96 is fitted to the attaching portion 186.

An overview of the printing operation of the printer 1 will be explained with reference to FIGS. 1 and 2. The operating of the first drive motor 26 and the second drive motor 16 causes the first suction cap 50 and the second suction cap 60 to move from their respective sealing positions to their retracted positions. In a case where the cloth (not shown in the drawings) that is affixed to the platen 5 is conveyed in the front-rear direction along the pair of the rails (not shown in the drawings), the carriage 15, which is in the standby position, moves reciprocally along the guide rail 7 and the guide shaft 9 above the cloth. In this case, first, the first head unit 10 discharges the white ink onto the surface of the cloth that is being conveyed. Next, the second head unit 20 discharges the color inks in areas of the surface of the cloth where the white ink has been discharged. In this manner, the printer 1 prints a specified color image on the cloth. Because the color image is printed with the white ink serving as a base coat, a clear color image is printed even if the ground color of the cloth is dark. After the printing is performed, the carriage 15 returns to the standby position, and the first suction cap 50 and the second suction cap 60, which were in their retracted positions, move to their respective sealing positions. In this way, the first discharge surface 12 and the second discharge surface 22, which are capped, are kept moist, and the inks that have adhered to the discharge surfaces 12, 22 are prevented from drying.

The operation of the maintenance mechanism 30 for purging and the like will be explained with reference to FIGS. 6 to 10. The purging and the like are performed in the same manner for both the first discharge surface 12 and the second discharge surface 22. The purging and the like are also performed in the same manner for both the first discharge area and the second discharge areas of the first discharge surface 12. In the explanation that follows, the operation for purging and the like will be explained only with respect to the first discharge area.

Figure 8:
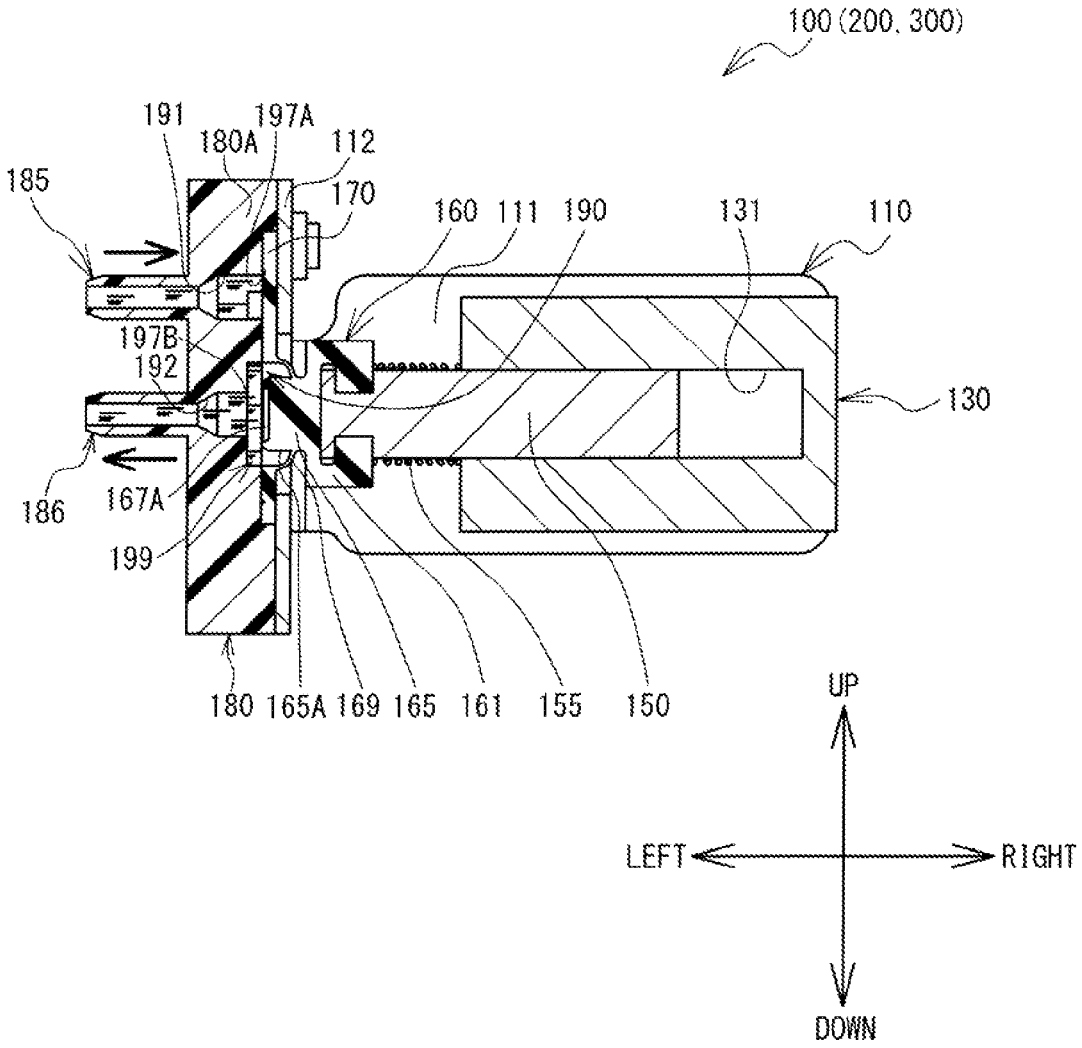
FIG. 8 is a sectional view in a case where the valve member 160 of the electromagnetic valve 100 in FIG. 6 has been shifted to an open orientation.

A case in which the maintenance mechanism 30 performs purging will be explained with reference to FIGS. 6 to 8. In a case where purging is performed, the carriage 15 is in the standby position, the first suction cap 50 and the second suction cap 60 are in their sealing positions, and the electromagnetic valves 100, 200, 300 that are provided in the maintenance mechanism 30 are all in their off states.

The maintenance mechanism 30 switches to the on state the electromagnetic valve 100 that is provided in the right side waste liquid flow path 76. When the electromagnetic valve 100 is switched to the on state, the drive portion 150 moves to the right in opposition to the elastic force of the coil spring 155. As the drive portion 150 moves, the attaching portion 161 and the sealing portion 165 move to the right along with the drive portion 150. The moving of the sealing portion 165 to the right causes the left side of the sealing portion 165, which has blocked the groove 190, to move to the right (refer to FIG. 8) of the bottom face 182A (refer to FIG. 4). The groove 190 is opened.

In contrast, the movement of the cover portion 170 to the right is restricted by the second plate portion 112. Therefore, only the base edge of the connecting portion 169, which is in the extended orientation, in which it extends in the radial direction, with the circumferential edge of the opening 171 as its outer edge and the outer circumferential face 165A as its base edge, moves to the right along with the sealing portion 165. This causes the orientation of the connecting portion 169 to change, such that its base edge is positioned to the right and its outer edge is positioned to the left. In other words, the connecting portion 169 shifts to a flexed orientation, which is an orientation in which the connecting portion 169 bends away from the outer circumferential face 165A as one moves to the left from the base edge.

This causes the valve member 160, which was in the blocking orientation, to shift to an open orientation, which is an orientation in which it opens the groove 190. In other words, when the electromagnetic valve 100 is switched from the off state to the on state, the drive portion 150 shifts the valve member 160 from the blocking orientation to the open orientation in opposition to the elastic force of the coil spring 155, thereby connecting the right side space 51 and the first suction pump 41 with each other.

The first suction pump 41 puts the right side waste liquid flow path 76 and the right side space 51 into a negative pressure state. The white ink is forcibly drained out from the nozzle that is provided in the first discharge area. Foreign matter, air bubbles, and the like that are in the interior of the first discharge portion 11 are thus removed. The white ink that has been drained out, in a state in which it contains foreign matter and the like, is drawn by the first suction pump 41 through the first flow path portion 77, the first through passage 191, the supply opening 197A (refer to FIG. 4), the groove 190, the drain opening 197B (refer to FIG. 4), the second through passage 192, and the second flow path portion 78, in that order. At this time, the white ink flows into and out of the interior of the electromagnetic valve 100. When the white ink that has been drawn by the first suction pump 41 has been sent to the waste liquid tank 34 and stored as a waste liquid, the purging is terminated.

Note that when the first suction pump 41 puts the right side waste liquid flow path 76 and the right side space 51 into a negative pressure state, the second flow path portion 78 of the left side waste liquid flow path 74, the second cleaning liquid flow path 86 of the right side cleaning liquid flow path 83, and the second outside air supply flow path 96 of the outside air supply flow path 90 are also put into a negative pressure state.

A case in which the maintenance mechanism 30 performs aspiration will be explained with reference to FIG. 9. Aspiration is performed on the first discharge area after the purging that is described above. In other words, the electromagnetic valve 100 that is provided in the right side waste liquid flow path 76 remains in the on state.

The maintenance mechanism 30 switches to the on state the electromagnetic valve 300 that is provided in the outside air supply flow path 90. Connecting the branching portion 32 to the outside air causes the outside air to be drawn into the second outside air supply flow path 96, which is in a negative pressure state. The outside air is sent to the first suction pump 41 through the branching portion 32, the right side space 51, the first flow path portion 77, the electromagnetic valve 100, and the second flow path portion 78, in that order. When the outside air that flows into the right side space 51 is sent to the first flow path portion 77, the white ink that has accumulated in the first suction cap 50 and the white ink that has adhered to and accumulated on the first discharge surface 12 flow together with the outside air toward the first suction pump 41. In this manner, the white ink that has remained in the first suction cap 50 and the first discharge surface 12 after the purging is removed.

The electromagnetic valves 100, 300 that have been switched to their on states are switched to there off states. The respective valve members 160 in the electromagnetic valves 100, 300 are shifted from their open orientations to their blocking orientations by the elastic forces of the respective, coil springs 155, and the aspiration is terminated.

A case in which the maintenance mechanism 30 performs cleaning will be explained with reference to FIGS. 8 and 10. In a case where cleaning is performed, the carriage 15 (refer to FIG. 1) is in the standby position, the first suction cap 50 and the second suction cap 60 are in their sealing positions, and the electromagnetic valves 100, 200, 300 that are provided in the maintenance mechanism 30 are all in their off states.

The maintenance mechanism 30 switches to their on states the electromagnetic valve 100 that is provided in the right side waste liquid flow path 76 and the electromagnetic valve 200 that is provided in the right side cleaning liquid flow path 83. The respective valve members 160 in the electromagnetic valves 100, 200 shift to their open orientations, thereby connecting the cleaning liquid tank 35 and the first suction pump 41 with each other. The first suction pump 41 draws the cleaning liquid from the cleaning liquid tank 35 by putting the right side waste liquid flow path 76, the right side space 51, and the right side cleaning liquid flow path 83 into a negative pressure state.

The cleaning liquid that flows through the right side cleaning liquid flow path 83 flows into the right side space 51 after passing through the first cleaning liquid flow path 85, the electromagnetic valve 200, and the second cleaning liquid flow path 86, in that order. The cleaning liquid that has flowed into the right side space 51 cleans the first discharge area of the first discharge surface 12.

The cleaning liquid that has cleaned the first discharge area is drawn to the first suction pump 41 through the first through passage 191, the groove 190, and the second through passage 192, in that order, in the same manner as the white ink that was drained, out of the nozzle during the purging. Thereafter, the cleaning liquid is stored in the waste liquid tank 34 as a waste liquid. The electromagnetic valves 100, 200 are sequentially switched to their off states, and the cleaning is terminated. Performing the cleaning prevents the white ink from sticking to the nozzle of the first discharge area and clogging the nozzle. Note that after the cleaning has been performed, it sometimes happens that the cleaning liquid accumulates inside the groove 190 between the lower end of the lower portion 199 and the area around the center of the drain opening 197B.

In the printer 1 that is explained above, when the purging of the first discharge area is performed, the white ink that has been discharged from the nozzle is drawn to the first suction pump 41 through the first through passage 191, the groove 190, and the second through passage 192, in that order. Here, the second through passage 192 is disposed farther in the direction of the force of gravity than is the first through passage 191, so the white ink that flows down to the groove 190 from the first through passage 191 easily flows out to the second through passage 192. Therefore, when the valve member 160 of the electromagnetic valve 100 shifts to the blocking orientation, the white ink that has been drawn by the first suction pump 41 tends not to accumulate in the interior of the electromagnetic valve 100. The white ink tends not to accumulate in the interior of the electromagnetic valve 100 when the electromagnetic valve 100 has returned to the off state. Accordingly, any tendency of white ink not to flow easily through the right side waste liquid flow path 76, due to the white ink's accumulating in and sticking to the interior of the electromagnetic valve 100, is suppressed. By making it difficult for the white ink to accumulate in the interior of the electromagnetic valve 100, the printer 1 is able to perform better maintenance of the first discharge portion 11. The printer 1 is therefore able to prevent a drop in the printing quality by preventing defective discharging of the white ink that is due to poor maintenance of the first discharge portion 11.

Furthermore, the groove width of the groove 190 of the electromagnetic valve 100 widens in the front-rear direction from the first through passage 191 toward the second through passage 192. The white ink that flows through the groove 190 when the purging is performed flows easily toward the lower side, which is the side where the second through passage 192 is. Therefore, the white ink is even less likely to accumulate in the interior of the electromagnetic valve 100. Accordingly, the printer 1 is able to do an even better job of performing the maintenance of first discharge portion 11. That makes it possible for the printer 1 to more reliably prevent a drop in the printing quality by more reliably preventing defective discharging of the white ink that is due to poor maintenance of the first discharge portion 11.

The white ink also accumulates in the lower end of the groove 190 in a case where some of the white ink remains in the opened groove 190 after the purging has been performed. The accumulating of the white ink in the lower end of the groove 190 reduces the surface area where there is contact between the white ink and the air. The white ink is therefore less likely to stick to the groove 190. In a case where the purging and the like are performed for the first discharge portion 11, the white ink and the cleaning liquid are inhibited from becoming resistant to flowing through the electromagnetic valve 100, so the printer 1 can perform good maintenance of the first discharge portion 11 more reliably.

Furthermore, when the valve member 160 of the electromagnetic valve 100 shifts to the blocking orientation, it seals the drain opening 197B. When the purging of the first discharge area is performed, the second flow path portion 78 of the left side waste liquid flow path 74 is put into a negative pressure state. Therefore, the force that is generated by putting the second flow path portion 78 into a negative pressure state, in addition to the elastic force of the coil spring 155, causes the sealing face 167A of the electromagnetic valve 100 that is provided in the left side waste liquid flow path 74 to fit more tightly against the groove bottom 197 and to seal the drain opening 197B more firmly. The printer 1 is therefore able to improve the sealing performance of the electromagnetic valve 100 when the connection between the second flow path portion 78 and the left side space 52 of the first suction cap 50 is cut off. The improving of the sealing performance of the electromagnetic valve 100 by putting the second flow path portion 78 into a negative pressure state makes it possible for the printer 1 to reduce the elastic force that the coil spring 155 imparts to the valve member 160 when the drain opening 197B is sealed by the sealing face 167A. In addition, in the electromagnetic valve 100, the reducing of the elastic force of the coil spring 155 makes it possible to reduce the driving force that is required in order for the drive portion 150 to move in opposition to the elastic force of the coil spring 155. Therefore, the electromagnetic valve 100 can be made more compact than an electromagnetic valve or the like that cuts off the connection between the second flow path portion 78 and the left side space 52 by pressing a part of the left side waste liquid flow path 74 which is the flexible tube member from the outside in the radial direction so as to pinch it closed, and by blocking a tube cross section of the left side waste liquid flow path 74, for example, so it is possible for the printer 1 to be made more compact.

Furthermore, after the electromagnetic valve 100 that is provided in the right side waste liquid flow path 76 of the first suction flow path 71 and the electromagnetic valve 200 that is provided in the right side cleaning liquid flow path 83 have shifted their respective valve members 160 to their open orientations, the first suction pump 41 draws on the cleaning liquid such that the first discharge area is cleaned by the cleaning liquid. In this way, the white ink is prevented from sticking to the nozzle in the first discharge area, and the clogging of the nozzle is prevented. The flowing of the cleaning liquid through the right side waste liquid flow path 76 causes the white ink that accumulates in the right side waste liquid flow path 76 to flow together with the cleaning liquid to the first suction pump 41. This inhibits the liquids from sticking to the right side waste liquid flow path 76, so even better maintenance of the first discharge portion 11 is performed. Accordingly, the printer 1 is able to more reliably prevent a drop in the printing quality by more reliably preventing defective discharging of the white ink that is due to poor maintenance of the first discharge portion 11.

Furthermore, after the cleaning has been performed, it sometimes happens that the cleaning liquid accumulates between the lower end of the lower portion 199 and the area around the center of the drain opening 197B. Thus, even in a case where the white ink accumulates in the lower part of the groove 190, it mixes with the accumulated cleaning liquid, so the sticking of the white ink to the interior of the electromagnetic valve 100 is inhibited. Therefore, any tendency of white ink and the cleaning liquid to resist flowing through the interior of the electromagnetic valve 100 when maintenance of the first discharge portion 11 is performed is suppressed more reliably, so the printer 1 is able to perform good maintenance of the first discharge portion 11 more reliably.

The second outside air supply flow path 96 of the outside air supply flow path 90 is also put into a negative pressure state when purging is performed on the first discharge area. That means that the force that is generated by putting the second outside air supply flow path 96 into a negative pressure state, in addition to the elastic force of the coil spring 155, causes the valve member 160 of the electromagnetic valve 300 that is provided in the outside air supply flow path 90 to fit more tightly against the groove bottom 197 and to seal the drain opening 197B more firmly. Therefore, when the printer 1 performs purging, the printer 1 is able to improve the sealing performance of the electromagnetic valve 300, in which the valve member 160 is in the blocking orientation.

Furthermore, the disposing of the electromagnetic valve 300 in the opposite direction from the direction of the force of gravity in relation to the first discharge surface 12 means that the white ink is prevented from flowing backward into the electromagnetic valve 300. Because the white ink is prevented from accumulating in and sticking to the interior of the electromagnetic valve 300, the printer 1 is able to do a better job of cleaning the first discharge portion 11.

Furthermore, in most cases, the pigment particles in the white ink are larger than the pigment particles in the color inks, so the pigment particles in the white ink tend to settle out more readily than do the pigment particles in the color inks. Therefore, the white ink tends to accumulate more readily than do the color inks in the valves that are able to cut off the connections between the first suction pump 41 and the first suction cap 50. However, in the electromagnetic valve 100 with which the printer 1 is provided, because the second through passage 192 is disposed farther in the direction of the force of gravity than is the first through passage 191, the white ink that is drawn by the first suction pump 41 tends not to accumulate in the interior of the electromagnetic valve 100. Moreover, the white ink tends to accumulate in the nozzle of the first discharge surface 12 and in the first suction flow path 71. Even in this case, because the maintenance mechanism 30 is provided with the first suction flow path 71 and the second suction flow path 72, purging can be performed independently for each of the first discharge portion 11 and the second discharge portion 21. In other words, the printer 1 is able to perform purging for only the first discharge portion 11 that discharges the white ink, with whatever frequency is necessary. This makes it possible for the printer 1 to prevent a drop in the printing quality by preventing defective discharging of the white ink that is due to poor maintenance of the first discharge portion 11.

Note that the printer in the present disclosure is not limited to the embodiment that is described above, and various types of modifications may be made within the scope of the claims of the present disclosure. For example, in addition to the inks that are used as examples above, the liquids that the printer 1 discharges may also be inks of other colors, such as gold, silver, and the like.

Furthermore, in the embodiment that is described above, the white ink is used as the first-stage processing liquid, and the color inks are used as the second-stage processing liquids. However, the combinations of the first-stage processing liquid and the second-stage processing liquids, as well as the types and the like of the liquids, can be modified as desired and are not limited to the combinations, types, and the like in the present embodiment. For example, a processing agent that improves the fastness of the inks may be used as the first-stage processing liquid, and the color inks may be used as the second-stage processing liquids. To take another example, a processing agent for discharge printing may be used as the first-stage processing liquid, and an ink for discharge printing may be used as the second-stage processing liquid. In yet another example, the same type of liquid may be used as both the first-stage processing liquid and the second-stage processing liquid.

Furthermore, in the embodiment that is described above, the attaching portions 185, 186 that are provided in the electromagnetic valves 100, 300 are not limited to being provided on the left side face of the wall portion 180. For example, instead of the attaching portions 185, 186 being provided on the left side face. of the wall portion 180, the attaching portion 185 may be provided on a top face, and the attaching portion 186 may be provided on a bottom face.

What is claimed is:

1. A printer, comprising:

at least one head that includes a discharge surface that is provided with a nozzle that is configured to discharge a liquid;

at least one cap member that is configured to move between a sealing position and a retracted position, the sealing position being a position where the at least one cap member seals the discharge surface, and the retracted position being a position where the at least one cap member has retracted from the discharge surface;

at least one movement device that moves the at least one cap member;

at least one waste liquid flow path that is provided with a first flow path portion and a second flow path portion;

at least one suction pump that is connected to the at least one waste liquid flow path and that is configured to put the at least one waste liquid flow path into a negative pressure state; and a first electromagnetic valve that is provided in the at least one waste liquid flow path, that is connected to the at least one cap member by the first flow path portion, that is connected to the at least one suction pump by the second flow path portion, that is configured to cut off the connection between the at least one cap member and the at least one waste liquid flow path, and that is provided with a first wall portion, a first valve member, a first energizing member, and a first drive portion, the first wall portion including a side face portion on which are formed an inflow opening, an outflow opening, and a connecting groove, the inflow opening connecting to the first flow path portion, the outflow opening connecting to the second flow path portion and being disposed farther in the direction of the force of gravity than is the inflow opening, and the connecting groove connecting the inflow opening and the outflow opening, the first valve member being configured to shift between a first blocking orientation and a first open orientation, the first blocking orientation being an orientation in which the first valve member blocks the connecting groove by being disposed in a position where it is opposite the side face portion and covers the connecting groove, and the first open orientation being an orientation in which the first valve member opens the connecting groove, the first energizing member imparting to the first valve member a first elastic force that shifts the first valve member to the first blocking orientation, and the first drive portion shifting the first valve member from the first blocking orientation to the first open orientation in opposition to the first elastic force.

2. The printer according to claim 1, wherein a groove width of the connecting groove becomes greater from the inflow opening toward the outflow opening.

3. The printer according to claim 1, wherein the connecting groove is provided with a first connecting opening that connects with the outflow opening, and the first valve member seals the first connecting opening when the first valve member has shifted to the first blocking orientation.

4. The printer according to claim 1, further comprising:

a storage portion that stores a cleaning liquid that cleans the discharge surface;

a cleaning liquid flow path that connects the storage portion and the at least one cap member; and a cut-off device that is provided in the cleaning liquid flow path and is configured to cut off the connection between the storage portion and the at least one cap member.

5. The printer according to claim 4, further comprising:

an outside air supply flow path that is provided with a first outside air supply flow path and a second outside air supply flow path and that connects the outside air with a branching portion, the branching portion being provided in the cleaning liquid flow path and branching off from the cleaning liquid flow path between the at least one cap member and the cut-off device; and a second electromagnetic valve that is provided in the outside air supply flow path, that is connected to the outside air by the first outside air supply flow path, that is connected to the branching portion by the second outside air supply flow path, that is configured to cut off the connection between the outside air and the branching portion, and that is provided with a second wall portion, a second valve member, a second energizing member, and a second drive portion, the second wall portion including a wall face portion on which are formed an inflow opening, an outflow opening, and a groove portion, the inflow opening connecting to the first outside air supply flow path, the outflow opening connecting to the second outside air supply flow path, and the groove portion connecting the inflow opening and the outflow opening and being provided with a second connecting opening that connects with the outflow opening, the second valve member being configured to shift between a second blocking orientation and a second open orientation, the second blocking orientation being an orientation in which the second valve member blocks the groove portion by being disposed in a position where it is opposite the wall face portion and covers the groove portion, and the second open orientation being an orientation in which the second valve member opens the groove portion, the second valve member sealing the second connecting opening when the second valve member has shifted to the second blocking orientation, the second energizing member imparting to the second valve member a second elastic force that shifts the second valve member to the second blocking orientation, and the second drive portion shifting the second valve member from the second blocking orientation to the second open orientation in opposition to the second elastic force.

6. The printer according to claim 5, wherein the second electromagnetic, valve is disposed in the opposite direction from the direction of the force of gravity in relation to the discharge surface.

7. The printer according, to claim 1, wherein the at least one head includes a first head that has a first discharge surface that is configured to discharge a white ink and a second head that has a second discharge surface that is configured to discharge a color ink that is different from the white ink, the at least one cap member includes a first cap member that is configured to seal the first discharge surface and a second cap member that is configured to seal the second discharge surface, the at least one movement device includes a first movement device that moves the first cap member and a second movement device that moves the second cap member, the at least one waste flow path includes a first waste liquid flow path that is connected to the first cap member and a second waste liquid flow path that is connected to the second cap member, the at least one suction pump includes a first suction pump that is connected to the first waste liquid flow path and that is configured to put the first waste liquid flow path into a negative pressure state, and a second suction pump that is connected to the second waste liquid flow path and that is configured to put the second waste liquid flow path into a negative pressure state, the first electromagnetic valve is provided in at least the first waste liquid flow path, of the first waste liquid flow path and the second waste liquid flow path, and the first flow path portion and the second flow path portion are formed in at least the first waste liquid flow path, in which the first electromagnetic valve is provided, of the first waste liquid flow path and the second waste liquid flow path.

* * * * *